US009799286B2

(12) United States Patent
Zhao et al.

(10) Patent No.: US 9,799,286 B2
(45) Date of Patent: Oct. 24, 2017

(54) GOA CIRCUITS AND LIQUID CRYSTAL DEVICES

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Mang Zhao, Guangdong (CN); Juncheng Xiao, Guangdong (CN); Yong Tian, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 216 days.

(21) Appl. No.: 14/781,293

(22) PCT Filed: Aug. 28, 2015

(86) PCT No.: PCT/CN2015/088378
§ 371 (c)(1),
(2) Date: Sep. 29, 2015

(87) PCT Pub. No.: WO2017/031773
PCT Pub. Date: Mar. 2, 2017

(65) Prior Publication Data

US 2017/0148401 A1 May 25, 2017

(30) Foreign Application Priority Data

Aug. 24, 2015 (CN) ..... 2015 1 0523099

(51) Int. Cl.
*G09G 3/36* (2006.01)

(52) U.S. Cl.
CPC ..... *G09G 3/3648* (2013.01); *G09G 3/3677* (2013.01); *G09G 2300/0809* (2013.01); *G09G 2310/08* (2013.01)

(58) Field of Classification Search
CPC ..... G09G 3/3648; G09G 3/3677; G09G 2300/0809; G09G 2310/08
See application file for complete search history.

(56) References Cited

U.S. PATENT DOCUMENTS

2006/0227093 A1* 10/2006 Jang ..... G09G 3/20 345/100
2017/0124975 A1* 5/2017 Xiao ..... G09G 3/3677

* cited by examiner

*Primary Examiner* — Kumar Patel
*Assistant Examiner* — Sejoon Ahn
(74) *Attorney, Agent, or Firm* — Andrew C. Cheng

(57) ABSTRACT

A GOA circuit and LCD are disclosed. The GOA circuit includes cascaded GOA units and a control module. Each of the GOA units is driven by a first level of transfer clock, a second level of transfer clock, a first control clock and a second control clock to charge horizontal signal lines corresponding to a display area. The control module masks the first level of transfer clock and the second level of transfer clock when all of the horizontal signal lines are charged completely by the GOA circuit, such that the gate driving signals on the horizontal signal lines are discharged until the level equals to the predetermined level. In this way, the horizontal signal lines are prevented from generating redundant pulse signals before the first gate driving signals are outputted, which ensures the normal operations of the GOA circuit.

14 Claims, 4 Drawing Sheets

GOA CIRCUITS AND LIQUID CRYSTAL DEVICES

BACKGROUND OF THE INVENTION

1. Field of the Invention

The present disclosure relates to liquid crystal display technology, and more particularly to a gate driver on array (GOA) circuit and the liquid crystal device.

2. Discussion of the Related Art

Currently, the GOA circuit may adopt All-Gate-on functions. After completing the All-Gate-on functions, the level may not become invalid due to the bootstrap capacitance. As such, it is possible that the redundant gate driving signals may cause the circuit malfunction.

The All-Gate-on function relates to setting all of the gate driving signals of the GOA circuit to be valid level so as to charge the horizontal scanning lines simultaneously. In this way, the remaining charges for each of the pixels of the LCD may be cleaned so as to resolve the blur issue occurring during startup and shutdown.

SUMMARY

The object of the invention is to provide a GOA circuit and a LCD to avoid redundant pulse signals occurring on the horizontal scanning lines before the first gate driving signals are outputted, which ensures the operations of the GOA circuit.

In one aspect, a GOA circuit includes: a plurality of cascaded GOA units, each of the GOA units being driven by a first level of transfer clock, a second level of transfer clock, a first control clock and a second control clock to charge horizontal signal lines corresponding to a display area, the first level of transfer clock and the second level of transfer clock configured for controlling an input of level signals of the GOA units and generation of gate driving signals, the first control clock and the second control clock configured for controlling the gate driving signals to be at a predetermined level, wherein the level signals are turn-on pulse signals or the gate driving signals between the adjacent GOA units; a control module configured for masking the first level of transfer clock and the second level of transfer clock when all of the horizontal signal lines being charged completely by the GOA circuit, the gate driving signals on the horizontal signal lines controlled by the first control clock and the second control clock being discharged until the level of the gate driving signals equals to the predetermined level, such that the horizontal signal lines being prevented from generating redundant pulse signals before the first gate driving signals are outputted;

the first control module comprising a first control transistor and a second control transistor, first ends of the first control transistor and the second control transistor being connected to receive enable signals, second ends of the first control transistor and the second control transistor correspondingly connecting to the first clock signals and the third clock signals, third ends of the first control transistor and the second control transistor connecting to the GOA units, when all of the horizontal scanning lines being completely charged by the GOA circuit, the enable signals controlling the first control transistor and the second control transistor to mask the first level of transfer clock and the second level of transfer clock such that the first control clock and the second control clock controlling the gate driving signals on all of the horizontal signal lines to be at the predetermined level; the GOA circuit receiving first clock signals, second clock signals, third clock signals, and fourth clock signals, and the first clock signals, the second clock signals, the third clock signals, and the fourth clock signals being respectively valid within one operating period in turn; the GOA circuit comprising a first GOA sub-circuit being formed by the cascaded GOA unis at odd levels, when being driven by the first level of transfer clock, the second level of transfer clock, the first control signals, and the second control signals, the first GOA sub-circuit charging the horizontal signal lines at odd levels; within the first GOA sub-circuit, the first level of transfer clock and the second level of transfer clock corresponding to the first clock signals and the third clock signals, and the first control signals and the second control signals corresponding to the second clock signals and the fourth clock signals; the GOA circuit comprising a first control module corresponding to the first GOA sub-circuit, the first control module configured for masking the first clock signals and the third clock signals of the first GOA sub-circuit such that the gate driving signals on the horizontal signal lines at odd levels being discharged until the level equals to the predetermined level when being controlled by the second clock signals and the fourth clock signals; the GOA circuit further comprising a second GOA sub-circuit being formed by the cascaded GOA unis at even levels, when being driven by the first level of transfer clock, the second level of transfer clock, the first control signals, and the second control signals, the second GOA sub-circuit charging the horizontal signal lines at even levels; within the second GOA sub-circuit, the first level of transfer clock and the second level of transfer clock corresponding to the second clock signals and the fourth clock signals, and the first control signals and the second control signals corresponding to the first clock signals and the third clock signals; and the GOA circuit comprising a second control module corresponding to the second GOA sub-circuit, the second control module configured for masking the second clock signals and the fourth clock signals of the first GOA sub-circuit such that the gate driving signals on the horizontal signal lines at even levels being discharged until the level equals to the predetermined level when being controlled by the first clock signals and the third clock signals.

Wherein the first control transistor and the second control transistor are PMOS transistors, the first ends, the second ends, the third ends of the first control transistor and the second control transistor respectively correspond to the gate, the drain and the source of the PMOS transistors, when the enable signals are at high level, the first control transistor and the second control transistor are turned off.

In another aspect, a GOA circuit includes: a plurality of cascaded GOA units, each of the GOA units being driven by a first level of transfer clock, a second level of transfer clock, a first control clock and a second control clock to charge horizontal signal lines corresponding to a display area, the first level of transfer clock and the second level of transfer clock configured for controlling an input of level signals of the GOA units and generation of gate driving signals, the first control clock and the second control clock configured for controlling the gate driving signals to be at a predetermined level, wherein the level signals are turn-on pulse signals or the gate driving signals between the adjacent GOA units; and a control module configured for masking the first level of transfer clock and the second level of transfer clock when all of the horizontal signal lines being charged completely by the GOA circuit, the gate driving signals on the horizontal signal lines controlled by the first control clock and the second control clock being discharged until the level of the gate driving signals equals to the predetermined level, such that the horizontal signal lines being prevented from generating redundant pulse signals before the first gate driving signals are outputted.

Wherein the first control module includes a first control transistor and a second control transistor, first ends of the first control transistor and the second control transistor are connected to receive enable signals, second ends of the first control transistor and the second control transistor correspondingly connect to first clock signals and third clock signals, third ends of the first control transistor and the second control transistor connect to the GOA units, when all of the horizontal scanning lines are completely charged by the GOA circuit, the enable signals control the first control transistor and the second control transistor to mask the first level of transfer clock and the second level of transfer clock such that the first control clock and the second control clock control the gate driving signals on all of the horizontal signal lines to be at the predetermined level.

Wherein the first control transistor and the second control transistor are PMOS transistors, the first ends, the second ends, the third ends of the first control transistor and the second control transistor respectively correspond to the gate, the drain and the source of the PMOS transistors, when the enable signals are at high level, the first control transistor and the second control transistor are turned off.

Wherein the first control transistor and the second control transistor are NMOS transistors, the first ends, the second ends, the third ends of the first control transistor and the second control transistor respectively correspond to the gate, the drain and the source of the NMOS transistors, when the enable signals are at low level, the first control transistor and the second control transistor are turned off.

Wherein the GOA circuit receives the first clock signals, the second clock signals, the third clock signals, and the fourth clock signals, and the first clock signals, the second clock signals, the third clock signals, and the fourth clock signals are respectively valid within one operating period in turn; the GOA circuit comprising a first GOA sub-circuit being formed by the cascaded GOA unis at odd levels, when being driven by the first level of transfer clock, the second level of transfer clock, the first control signals, and the second control signals, the first GOA sub-circuit charges the horizontal signal lines at odd levels; within the first GOA sub-circuit, the first level of transfer clock and the second level of transfer clock corresponding to the first clock signals and the third clock signals, and the first control signals and the second control signals corresponding to the second clock signals and the fourth clock signals; and the GOA circuit includes a first control module corresponding to the first GOA sub-circuit, the first control module is configured for masking the first clock signals and the third clock signals of the first GOA sub-circuit such that the gate driving signals on the horizontal signal lines at odd levels being discharged until the level equals to the predetermined level when being controlled by the second clock signals and the fourth clock signals.

Wherein the GOA circuit further includes a second GOA sub-circuit being formed by the cascaded GOA unis at even levels, when being driven by the first level of transfer clock, the second level of transfer clock, the first control signals, and the second control signals, the second GOA sub-circuit charges the horizontal signal lines at even levels; within the second GOA sub-circuit, the first level of transfer clock and the second level of transfer clock correspond to the second clock signals and the fourth clock signals, and the first control signals and the second control signals correspond to the first clock signals and the third clock signals; and the GOA circuit includes a second control module corresponding to the second GOA sub-circuit, the second control module is configured for masking the second clock signals and the fourth clock signals of the first GOA sub-circuit such that the gate driving signals on the horizontal signal lines at even levels being discharged until the level equals to the predetermined level when being controlled by the first clock signals and the third clock signals.

Wherein the GOA unit includes a forward-backward scanning unit, an input control unit, a pull-up holding unit, an output control unit, a GAS signal operation unit, and a bootstrap capacitance unit; wherein the forward-backward scanning unit includes a first transistor, a second transistor, a third transistor, and a fourth transistor, the gate of the first transistor receives the first scanning control signals, the source of the first transistor receives the gate driving signals outputted from the GOA unit at the next level, the gate of the second transistor receives the second scanning control signals, the source of the second transistor receives the gate driving signals outputted by the GOA unit at the previous level, the drain of the first transistor and the second transistor are connected and then are further connected with the input control unit, the gate of the third transistor receives the first scanning control signals, the source of the third transistor receives the third control clock, the gate of the fourth transistor receives the second scanning control signals, the source of the fourth transistor receives the fourth control clock, the drains of the third transistor and the fourth transistor are connected and then are further connected with the pull-up holding unit;

the input control unit includes a fifth transistor, the gate of the fifth transistor receives the third transfer clock, the source of the fifth transistor is connected with the drains of the first transistor and the second transistor, and the drain of the fifth transistor connects with the gate signal point; the pull-up holding unit includes a sixth transistor, a seventh transistor, a ninth transistor, a tenth transistor, and a first capacitor, the gate of the sixth transistors connects with the common signal point, the source of the sixth transistors connects with the drain of the fifth transistor, the drain of the sixth transistors connects with a first constant-voltage source, the gate of the seventh transistor connects with the fifth transistor, the source of the seventh transistor connects with the common signal point, the drain of the seventh transistor connects with the first constant-voltage source, the gate of the ninth transistor and the source of the third transistor and the fourth transistor are connected, the source of the ninth transistor connects with a second constant-voltage source, the drain of the ninth transistor connects with the common signal point, the gate of the tenth transistor connects with the common signal point, the source of the tenth transistor connects with the gate driving signals, the drain of the tenth transistor connects with the first constant-voltage source, one end of the first capacitor connects with the first constant-voltage source, and the other end of the first capacitor connects with the common signal point; the output control includes an eleventh transistor and a second capacitor, the gate of the eleventh transistor connects with the gate signal point, the drain of the eleventh transistor connects with the gate driving signals, the source of the eleventh transistor receives the fourth level of transfer clock, one end of the second capacitor connects with the gate signal point, and the other end of the second capacitor connects with the gate driving signals; the GAS signal operation unit includes a thirteenth transistor and a fourth transistor, the gate and the drain of the thirteenth transistor and the fourth transistor receives the GAS signals, the drain of the thirteenth transistor connects with the first constant-voltage source, the source of the thirteenth transistor connects with the common signal point, the source of the thirteenth transistor connects with the gate driving signals; the bootstrap capacitance unit includes a bootstrap capacitance, one end of the bootstrap capacitance connects with the gate driving signals, and the other end of the bootstrap capacitance connected with the ground signals; and the third level of transfer clock and the fourth level of transfer clock correspond to the first level of transfer clock and the second level of transfer clock or the second level of transfer clock and the first level of transfer clock, and the third level of transfer clock and the fourth level of transfer clock correspond to the first control clock and the second control clock or the second control clock and the first control clock.

Wherein the GOA unit further includes a voltage regulation unit having an eighth transistor being serially connected between the source of the fifth transistor and the gate signal point, the gate of the eighth transistor connects with the second constant-voltage source, the drain of the eighth transistor connects with the drain of the fifth transistor, and the source of the eighth transistor connects with the gate signal point.

Wherein the GOA unit further includes a pull-up auxiliary unit having a twelfth transistor, the gate of the twelfth transistor connects with the drain of the first transistor and the second transistor, the source of the twelfth transistor connects with the common signal point, and the drain of the twelfth transistor connects with the first constant-voltage source.

In another aspect, a liquid crystal device (LCD) includes: a GOA circuit comprising a plurality of cascaded GOA units, each of the GOA units being driven by a first level of transfer clock, a second level of transfer clock, a first control clock and a second control clock to charge horizontal signal lines corresponding to a display area, the first level of transfer clock and the second level of transfer clock configured for controlling an input of level signals of the GOA units and generation of gate driving signals, the first control clock and the second control clock configured for controlling the gate driving signals to be at a predetermined level, wherein the level signals are turn-on pulse signals or the gate driving signals between the adjacent GOA units; and a control module configured for mask the first level of transfer clock and the second level of transfer clock when all of the horizontal signal lines being charged completely by the GOA circuit, the gate driving signals on the horizontal signal lines controlled by the first control clock and the second control clock being discharged until the level of the gate driving signals equals to the predetermined level, such that the horizontal signal lines being prevented from generating redundant pulse signals before the first gate driving signals are outputted.

Wherein the first control module includes a first control transistor and a second control transistor, first ends of the first control transistor and the second control transistor are connected to receive enable signals, second ends of the first control transistor and the second control transistor correspondingly connect to first clock signals and third clock signals, third ends of the first control transistor and the second control transistor connect to the GOA units, when all of the horizontal scanning lines are completely charged by the GOA circuit, the enable signals control the first control transistor and the second control transistor to mask the first level of transfer clock and the second level of transfer clock such that the first control clock and the second control clock control the gate driving signals on all of the horizontal signal lines to be at the predetermined level.

Wherein the first control transistor and the second control transistor are PMOS transistors, the first ends, the second ends, the third ends of the first control transistor and the second control transistor respectively correspond to the gate, the drain and the source of the PMOS transistors, when the enable signals are at high level, the first control transistor and the second control transistor are turned off.

Wherein the first control transistor and the second control transistor are NMOS transistors, the first ends, the second ends, the third ends of the first control transistor and the second control transistor respectively correspond to the gate, the drain and the source of the NMOS transistors, when the enable signals are at low level, the first control transistor and the second control transistor are turned off.

Wherein the GOA circuit receives the first clock signals, the second clock signals, the third clock signals, and the fourth clock signals, and the first clock signals, the second clock signals, the third clock signals, and the fourth clock signals are respectively valid within one operating period in turn; the GOA circuit comprising a first GOA sub-circuit being formed by the cascaded GOA unis at odd levels, when being driven by the first level of transfer clock, the second level of transfer clock, the first control signals, and the second control signals, the first GOA sub-circuit charges the horizontal signal lines at odd levels; within the first GOA sub-circuit, the first level of transfer clock and the second level of transfer clock corresponding to the first clock signals and the third clock signals, and the first control signals and the second control signals corresponding to the second clock signals and the fourth clock signals; and the GOA circuit includes a first control module corresponding to the first GOA sub-circuit, the first control module is configured for masking the first clock signals and the third clock signals of the first GOA sub-circuit such that the gate driving signals on the horizontal signal lines at odd levels being discharged until the level equals to the predetermined level when being controlled by the second clock signals and the fourth clock signals.

Wherein the GOA circuit further includes a second GOA sub-circuit being formed by the cascaded GOA unis at even levels, when being driven by the first level of transfer clock, the second level of transfer clock, the first control signals, and the second control signals, the second GOA sub-circuit charges the horizontal signal lines at even levels; within the second GOA sub-circuit, the first level of transfer clock and the second level of transfer clock correspond to the second clock signals and the fourth clock signals, and the first control signals and the second control signals correspond to the first clock signals and the third clock signals; and the GOA circuit includes a second control module corresponding to the second GOA sub-circuit, the second control module is configured for masking the second clock signals and the fourth clock signals of the first GOA sub-circuit such that the gate driving signals on the horizontal signal lines at even levels being discharged until the level equals to the predetermined level when being controlled by the first clock signals and the third clock signals.

Wherein the GOA unit includes a forward-backward scanning unit, an input control unit, a pull-up holding unit, an output control unit, a GAS signal operation unit, and a bootstrap capacitance unit; wherein the forward-backward scanning unit includes a first transistor, a second transistor, a third transistor, and a fourth transistor, the gate of the first transistor receives the first scanning control signals, the source of the first transistor receives the gate driving signals outputted from the GOA unit at the next level, the gate of the second transistor receives the second scanning control signals, the source of the second transistor receives the gate driving signals outputted by the GOA unit at the previous level, the drain of the first transistor and the second transistor are connected and then are further connected with the input control unit, the gate of the third transistor receives the first scanning control signals, the source of the third transistor receives the third control clock, the gate of the fourth transistor receives the second scanning control signals, the source of the fourth transistor receives the fourth control clock, the drains of the third transistor and the fourth transistor are connected and then are further connected with the pull-up holding unit; the input control unit includes a fifth transistor, the gate of the fifth transistor receives the third transfer clock, the source of the fifth transistor is connected with the drains of the first transistor and the second transistor, and the drain of the fifth transistor connects with the gate signal point; the pull-up holding unit includes a sixth transistor, a seventh transistor, a ninth transistor, a tenth transistor, and a first capacitor, the gate of the sixth transistors connects with the common signal point, the source of the sixth transistors connects with the drain of the fifth transistor, the drain of the sixth transistors connects with a first constant-voltage source, the gate of the seventh transistor connects with the fifth transistor, the source of the seventh transistor connects with the common signal point, the drain of the seventh transistor connects with the first constant-voltage source, the gate of the ninth transistor and the source of the third transistor and the fourth transistor are connected, the source of the ninth transistor connects with a second constant-voltage source, the drain of the ninth transistor connects with the common signal point, the gate of the tenth transistor connects with the common signal point, the source of the tenth transistor connects with the gate driving signals, the drain of the tenth transistor connects with the first constant-voltage source, one end of the first capacitor connects with the first constant-voltage source, and the other end of the first capacitor connects with the common signal point; the output control unit includes an eleventh transistor and a second capacitor, the gate of the eleventh transistor connects with the gate signal point, the drain of the eleventh transistor connects with the gate driving signals, the source of the eleventh transistor receives the fourth level of transfer clock, one end of the second capacitor connects with the gate signal point, and the other end of the second capacitor connects with the gate driving signals; the GAS signal operation unit includes a thirteenth transistor and a fourth transistor, the gate and the drain of the thirteenth transistor and the fourth transistor receives the GAS signals, the drain of the thirteenth transistor connects with the first constant-voltage source, the source of the thirteenth transistor connects with the common signal point, the source of the thirteenth transistor connects with the gate driving signals; the bootstrap capacitance unit includes a bootstrap capacitance, one end of the bootstrap capacitance connects with the gate driving signals, and the other end of the bootstrap capacitance connected with the ground signals; and the third level of transfer clock and the fourth level of transfer clock correspond to the first level of transfer clock and the second level of transfer clock or the second level of transfer clock and the first level of transfer clock, and the third level of transfer clock and the fourth level of transfer clock correspond to the first control clock and the second control clock or the second control clock and the first control clock.

Wherein the GOA unit further includes a voltage regulation unit having an eighth transistor being serially connected between the source of the fifth transistor and the gate signal point, the gate of the eighth transistor connects with the second constant-voltage source, the drain of the eighth transistor connects with the drain of the fifth transistor, and the source of the eighth transistor connects with the gate signal point.

Wherein the GOA unit further includes a pull-up auxiliary unit having a twelfth transistor, the gate of the twelfth transistor connects with the drain of the first transistor and the second transistor, the source of the twelfth transistor connects with the common signal point, and the drain of the twelfth transistor connects with the first constant-voltage source.

In view of the above, the horizontal signal lines are charged completed by the GOA circuit to mask the first level of transfer clock and the second level of transfer clock. As such, the first control clock and the second control clock controls the gate driving signals to be discharged until the level equals to the predetermined level. In this way, the horizontal signal lines are prevented from generating redundant pulse signals before the first gate driving signals are outputted, which ensures the normal operations of the GOA circuit.

DETAILED DESCRIPTION OF THE EMBODIMENTS

Embodiments of the invention will now be described more fully hereinafter with reference to the accompanying drawings, in which embodiments of the invention are shown.

Figure 1:
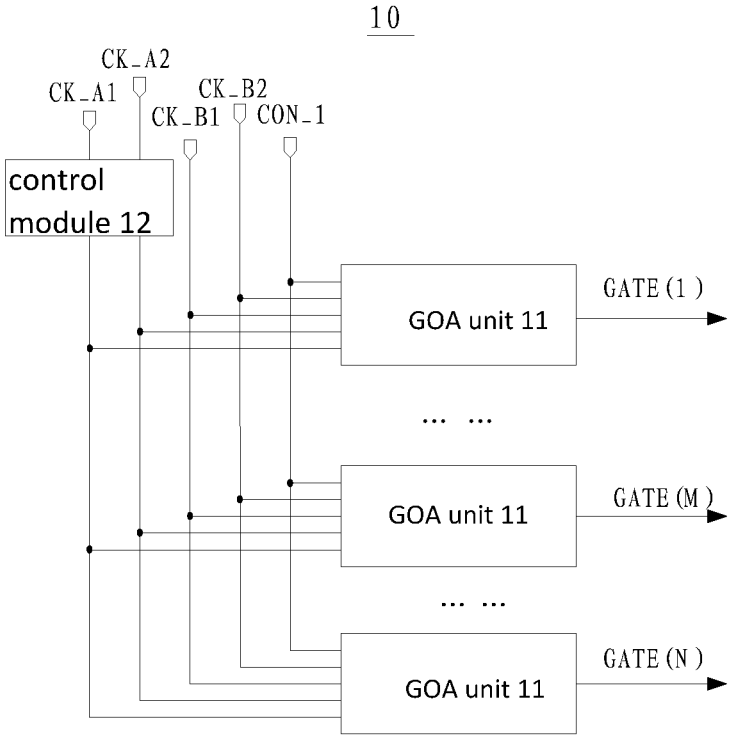
FIG. 1 is a schematic view of the GOA circuit in accordance with a first embodiment.

FIG. 1 is a schematic view of the GOA circuit in accordance with a first embodiment. As shown in FIG. 1, the GOA circuit 10 includes a plurality of cascaded GOA units 11 and a control module 12.

Each of the cascaded GOA units 11 charges the corresponding horizontal scanning lines when being driven by a first level of transfer clock (CK_A1), a second level of transfer clock (CK_A2), a first control clock (CK_B1), and a second control clock (CK_B2). The first level of transfer clock (CK_A1), and the second level of transfer clock (CK_A2) control an input of the level signals (CON_1) of the cascaded GOA units 11 and the generation of the gate driving signals GATE (N), wherein N is a natural number. The first control clock (CK_B1) and the second control clock (CK_B2) controls the gate driving signals GATE (N) to be at a predetermined level, which is the invalid level. The level signals (CON_1) may be turn-on pulse signals or the gate driving signals between adjacent cascaded GOA units 11.

The control module 12 respectively connects to the first level of transfer clock (CK_A1), the second level of transfer clock (CK_A2), and each of the cascaded GOA units 11. With such configuration, when the horizontal signal lines are completed charged by the GOA circuit 10, that is, the All-Gate-on function is completed, the first level of transfer clock (CK_A1) and the second level of transfer clock (CK_A2) are masked. When being controlled by the first control clock (CK_B1) and the second control clock (CK_B2), the gate driving signals GATE (N) are discharged until the level equaling to the predetermined level, i.e., the invalid level, so as to avoid the redundant pulse signals generated on the horizontal signal lines before the first gate driving signals GATE (1) is outputted.

Figure 2:
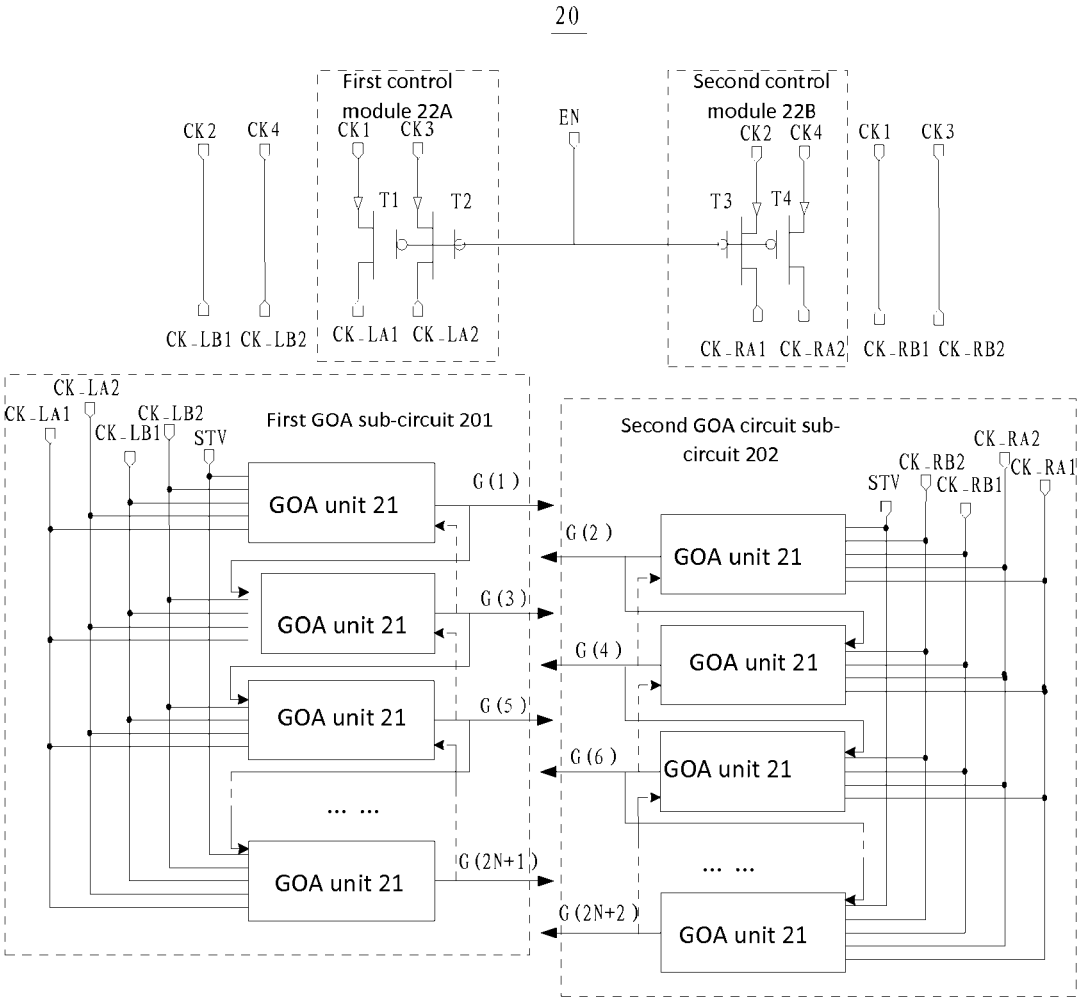
FIG. 2 is a schematic view of the GOA circuit in accordance with a second embodiment.

FIG. 2 is a schematic view of the GOA circuit in accordance with a second embodiment. As shown in FIG. 2, the GOA circuit 20 includes a first GOA sub-circuit 201 being formed by the GOA unis 21 at odd levels, a second GOA circuit sub-circuit 202 being formed by the GOA unis 21 at even level, a first control module 22A corresponding to the first GOA sub-circuit 201, and a second control module 22B corresponding to the second GOA circuit sub-circuit 202.

The first GOA sub-circuit 201 being formed by the GOA unis 21 at odd level relates to the GOA units 21 at the 1-th, 3-th, 5-th, . . . , (2N+1)-th level, wherein N is the natural number. The second GOA sub-circuit 202 being formed by the GOA unis 21 at even levels relates to the GOA units 21 at the 2-th, 4-th, 6-th, . . . , (2N+2)-th level, wherein N is the natural number.

The GOA circuit 20 receives first clock signals (CK1), second clock signals (CK2), third clock signals (CK3), and fourth clock signals (CK4). The first clock signals (CK1), the second clock signals (CK2), the third clock signals (CK3), and the fourth clock signals (CK4) are only valid within one operating period in turn.

The first GOA sub-circuit 201 and the 202 and the 202 are arranged two sides of the display area of the LCD. When being driven by the first level of transfer clock (CK_LA1), the second level of transfer clock (CK_LA2), the first control signals (CK_LB1), and the second control signals (CK_LB2), the first GOA sub-circuit 201 charges the horizontal signal lines at odd level. When being driven by the first level of transfer clock (CK_RA1), the second level of transfer clock (CK_RA2), the first control signals (CK_RB1), and the second control signals (CK_RB2), the second GOA sub-circuit 202 charges the horizontal signal lines at even level.

Within the first GOA sub-circuit 201, the first level of transfer clock (CK_LA1) and the second level of transfer clock (CK_LA2) correspond to the first clock signals (CK1) and the third clock signals (CK3), and the first control signals (CK_LB1) and the second control signals (CK_LB2) correspond to the second clock signals (CK2) and the fourth clock signals (CK4).

That is, the first clock signals (CK1) and the third clock signals (CK3) controls the input of the level signals of the GOA units 21 and the generations of the gate driving signals G(2N+1), wherein N is the natural number. The second clock signals (CK2) and the fourth clock signals (CK4) controls the gate driving signals G (2N+1) to be at the predetermined level, that is, the invalid level. When the GOA circuit 20 is a forward driving circuit (as indicated by the solid lines in the drawing), the level signals of the 1-th level GOA unit 21 may be the turn-on pulse signals (STV), the level signals of the 3-th level GOA unit 21 may be the gate driving signals G(1) of the 1-th level GOA unit 21, the level signals of the 5-th level GOA unit 21 may be the gate driving signals G(3) of the 3-th level GOA unit 21, and so on. When the GOA circuit 20 is a backward driving circuit (as indicated by the dashed lines in the drawing), the level signals of the 1-th level GOA unit 21 may be the gate driving signals G(3) of the 3-th level GOA unit 21, the level signals of the 3-th level GOA unit 21 may be the gate driving signals G(5) of the 5-th level GOA unit 21, and so on. The level signals of the last level GOA unit 21 may be the turn-on pulse signals (STV).

Within the second GOA circuit sub-circuit 202, the first level of transfer clock (CK_RA1) and the second level of transfer clock (CK_RA2) correspond to the second clock signals (CK2) and the fourth clock signals (CK4), and the first control signals (CK_RB1) and the second control signals (CK_RB2) correspond to the first clock signals (CK1) and the third clock signals (CK3).

That is, the second clock signals (CK2) and the fourth clock signals (CK4) controls the input of the level signals of the GOA units 21 and the generations of the gate driving signals G(2N+2), wherein N is the natural number. The first clock signals (CK1) and the third clock signals (CK3) controls the gate driving signals G (2N+2) to be at the predetermined level, that is, the invalid level. When the GOA circuit 20 is a forward driving circuit (as indicated by the solid lines in the drawing), the level signals of the 2-th level GOA unit 21 may be the turn-on pulse signals (STV), the level signals of the 4-th level GOA unit 21 may be the gate driving signals G(2) of the 2-th level GOA unit 21, the level signals of the 6-th level GOA unit 21 may be the gate driving signals G(4) of the 4-th level GOA unit 21, and so on. When the GOA circuit 20 is a backward driving circuit (as indicated by the dashed lines in the drawing), the level signals of the 2-th level GOA unit 21 may be the gate driving signals G(4) of the 4-th level GOA unit 21, the level signals of the 4-th level GOA unit 21 may be the gate driving signals G(6) of the 6-th level GOA unit 21, and so on. The level signals of the last level GOA unit 21 may be the turn-on pulse signals (STV).

The first control module 22A respectively connects to the first clock signals (CK1), the third clock signals (CK3) and the first GOA sub-circuit 201. With such configuration, when the horizontal signal lines are completed charged by the GOA circuit 20, the first clock signals (CK1) and the third clock signals (CK3) are masked. When being controlled by the second clock signals (CK2) and the fourth clock signals (CK4), the gate driving signals GATE (2N+1) at odd level are discharged until the level equals to the predetermined level, i.e., the invalid level, so as to avoid the redundant pulse signals generated on the horizontal signal lines before the first gate driving signals GATE (1) is outputted.

Specifically, the first control module 22A includes a first control transistor (T1) and a second control transistor (T2). First ends of the first control transistor (T1) and the second control transistor (T2) are connected to receive enable signals (EN). Second ends of the first control transistor (T1) and the second control transistor (T2) correspondingly connects to the first clock signals (CK1) and the third clock signals (CK3). Third ends of the first control transistor (T1) and the second control transistor (T2) connect to the GOA units 21 for outputting the first level of transfer clock (CK_LA1) and the second level of transfer clock (CK_LA2). When all of the horizontal scanning lines are completely charged by the GOA circuit 20, the enable signals (EN) turn off the first control transistor (T1) and the second control transistor (T2) to mask the first clock signals (CK1) and the third clock signals (CK3). As such, the gate driving signals G(2N+1), which are at odd level, on the horizontal signal lines are discharged until the level equals to the predetermined level, when being controlled by the second clock signals (CK2) and the fourth clock signals (CK4).

The second control module 22B respectively connects to the second clock signals (CK2), the fourth clock signals (CK4), and the second GOA circuit sub-circuit 202. With such configuration, when the horizontal signal lines are completed charged by the GOA circuit 20, the second clock signals (CK2) and the fourth clock signals (CK4) are masked. When being controlled by the first clock signals (CK1) and the third clock signals (CK3), the gate driving signals GATE (2N+2) at even level are discharged until the level equals to the predetermined level, i.e., the invalid level, so as to avoid the redundant pulse signals generated on the horizontal signal lines before the first gate driving signals GATE (1) is outputted.

Specifically, the second control module 22B includes a third control transistor (T3) and a fourth control transistor (T4). The first ends of the third control transistor (T3) and the fourth control transistor (T4) are connected to receive the enable signals (EN). Second ends of the third control transistor (T3) and the fourth control transistor (T4) correspondingly connects to the second clock signals (CK2) and the fourth clock signals (CK4). The third ends of the third control transistor (T3) and the fourth control transistor (T4) connects to the GOA unit 21 for outputting the first level of transfer clock (CK_RA1) and the second level of transfer clock (CK_RA2). When all of the horizontal signal lines are charged by the GOA circuit 20, the enable signals (EN) turn off the third control transistor (T3) and the fourth control transistor (T4) so as to mask the second clock signals (CK2) and the fourth clock signals (CK4). In this way, when being controlled by the first clock signals (CK1) and the third clock signals (CK3), the gate driving signals GATE (2N+2), which are at even level, on the horizontal signal lines are discharged until the level equals to the predetermined level.

In the embodiment, the first control transistor (T1), the second control transistor (T2), the third control transistor (T3), and the fourth control transistor (T4) are PMOS transistors. The first ends, the second ends, the third ends of the first control transistor (T1), the second control transistor (T2), and the third control transistor (T3) respectively correspond to the gate, the drain and the source of the PMOS transistors. When the enable signals (EN) are at high level, the first control transistor (T1) and the second control transistor (T2) are turned off.

In other embodiments, the first control transistor (T1), the second control transistor (T2), the third control transistor (T3) and the fourth control transistor (T4) may be NMOS transistors. The first ends, the second ends, the third ends of the first control transistor (T1), the second control transistor (T2), the third control transistor (T3), and the fourth control transistor (T4) respectively correspond to the gate, the drain and the source of the NMOS transistors. When the enable signals (EN) are at low level, the first control transistor (T1), the second control transistor (T2), the third control transistor (T3), and the fourth control transistor (T4) are turned off.

Figure 3:
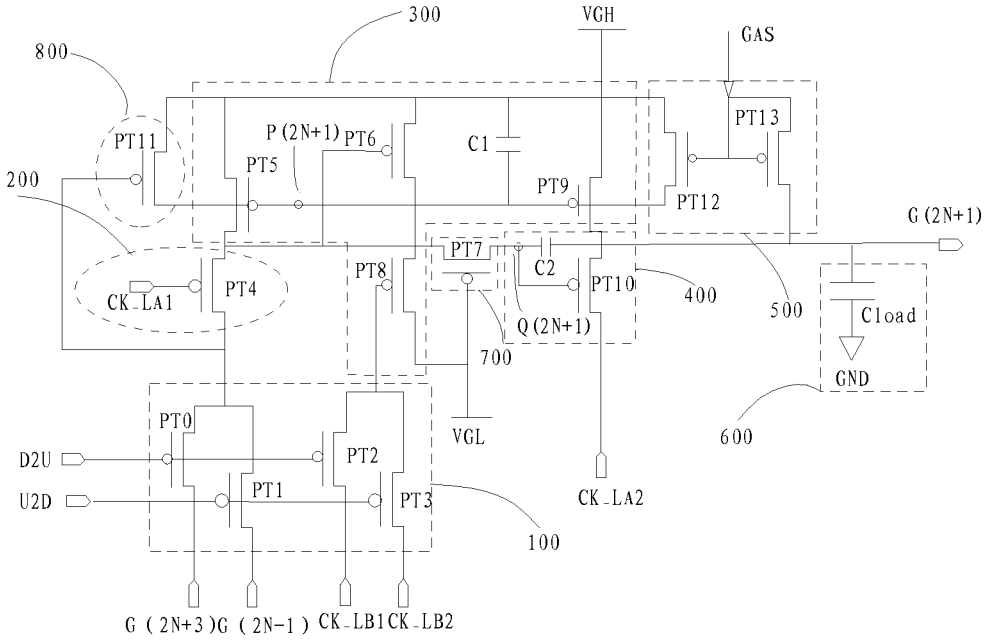
FIG. 3 is a schematic view showing the circuit principle of the GOA unit within the GOA circuit in accordance with the second embodiment.

FIG. 3 is a schematic view showing the circuit principle of the GOA unit within the GOA circuit in accordance with the second embodiment. As shown in FIG. 3, the GOA unit 21 includes a forward-backward scanning unit 100, an input control unit 200, a pull-up holding unit 300, an output control unit 400, a GAS signal operation unit 500, and a bootstrap capacitance unit 600. The GOA unit 21 at the (2N+1)-th level of the first GOA sub-circuit 201 and the PMOS circuit of the GOA unit 21 at the (2N+1)-th level will be the examples.

The forward-backward scanning unit 100 is configured for controlling the GOA circuit 20 to be forward driven or backward driven. In addition, under the control of the third control clock (CK_D1) and the fourth control clock (CK_D2), the common signal point P (2N+1) remains at low level. The third control clock (CK_D1) and the fourth control clock (CK_D2) corresponds to the first control signals (CK_LB1) and the second control signals (CK_LB2), or corresponds to the second control signals (CK_LB2) and the first control signals (CK_LB1).

The input control unit 200 is configured for controlling the input of the level signals in accordance with the third transfer clock (CK_C1) so as to complete the charging process toward the gate signal point Q (2N+1), wherein N is the natural number. The third transfer clock (CK_C1) may correspond to the first level of transfer clock (CK_LA1) or the second level of transfer clock (CK_LA2).

The pull-up holding unit 300 keeps the gate signal point Q (2N+1) at the predetermined level, i.e., invalid level, during non-operation period, in accordance with the common signal point P (2N+1).

The output control unit 400 controls the output of the gate driving signals G (2N+1) corresponding to the gate signal point Q (2N+1) in accordance with the fourth level of transfer clock (CK_C2). The fourth level of transfer clock (CK_C2) may correspond to the first level of transfer clock (CK_LA1) or the second level of transfer clock (CK_LA2).

The GAS signal operation unit 500 is configured for keeping the gate driving signals G (2N+1) at the valid level to implement the charging process of the horizontal signal lines corresponding to the GOA unit 21.

The bootstrap capacitance unit 600 is configured for pulling up the voltage of the gate signal point Q (2N+1).

In an example, the GOA unit is the PMOS circuit. The forward-backward scanning unit 100 includes a first transistor (PT0), a second transistor (PT1), a third transistor (PT2), and a fourth transistor (PT3). The gate of the first transistor (PT0) receives the first scanning control signals, i.e., backward scanning control signals (D2U). The source of the first transistor (PT0) receives the gate driving signals G (2N+3) outputted from the GOA unit 21 at the next level. The gate of the second transistor (PT1) receives the second scanning control signals, i.e., the forward scanning control signals (U2D). The source of the second transistor (PT1) receives the gate driving signals G (2N−1) outputted by the GOA unit at the previous level. The drain of the first transistor (PT0) and the second transistor (PT1) are connected and then are further connected with the input control unit 200. The gate of the third transistor (PT2) receives the first scanning control signals, i.e., the forward scanning control signals (D2U). The source of the third transistor (PT2) receives the third control clock (CK_D1), the gate of the fourth transistor (PT3) receives the second scanning control signals, i.e., the forward scanning control signals (U2D), the source of the fourth transistor (PT3) receives the fourth control clock (CK_D2), the drain of the third transistor (PT2) and the fourth transistor (PT3) are connected and then are further connected with the pull-up holding unit 300.

Regarding the GOA unit at the first level, the source of the second transistor (PT1) receives the turn-on pulse signals (STV). Regarding the GOA unit at the last level, the source of the first transistor (PT0) receives the turn-on pulse signals (STV).

The input control unit 200 includes a fifth transistor (PT4). The gate of the fifth transistor (PT4) receives the third transfer clock (CK_C1), the source of the fifth transistor (PT4) is connected with the drain of the first transistor (PT0)

and the second transistor (PT1). The drain of the fifth transistor (PT4) connects with the gate signal point Q (2N+1).

The pull-up holding unit 300 includes a sixth transistor (PT5), a seventh transistor (PT6), a ninth transistor (PT8), a tenth transistor (PT9), and a first capacitor (C1). The gate of the sixth transistors (PT5) connects with the common signal point P (2N+1). The source of the sixth transistors (PT5) connects with the drain of the fifth transistor (PT4). The drain of the sixth transistors (PT5) connects with a first constant-voltage source, that is, a constant positive-voltage source (VGH). The gate of the seventh transistor (PT6) connects with the fifth transistor (PT4). The source of the seventh transistor (PT6) connects with the common signal point P (2N+1). The drain of the seventh transistor (PT6) connects with the first constant-voltage source, i.e., constant positive-voltage source (VGH). The gate of the ninth transistor (PT8) and the source of the third transistor (PT2) and the fourth transistor (PT3) are connected. The source of the ninth transistor (PT8) connects with a second constant-voltage source, that is, a constant negative-voltage source (VGL). The drain of the ninth transistor (PT8) connects with the common signal point P (2N+1). The gate of the tenth transistor (PT9) connects with the common signal point P (2N+1). The source of the tenth transistor (PT9) connects with the gate driving signals G (2N+1). The drain of the tenth transistor (PT9) connects with the first constant-voltage source, i.e., the constant positive-voltage source (VGH). One end of the first capacitor (C1) connects with the first constant-voltage source, i.e., the constant positive-voltage source (VGH). The other end of the first capacitor (C1) connects with the common signal point P (2N+1).

The output control unit 400 includes an eleventh transistor (PT10) and a second capacitor (C2). The gate of the eleventh transistor (PT10) connects with the gate signal point Q (2N+1). The drain of the eleventh transistor (PT10) connects with the gate driving signals Q(2N+1). The source of the eleventh transistor (PT10) receives the fourth level of transfer clock (CK_C2). One end of the second capacitor (C2) connects with the gate signal point Q (2N+1), and the other end of the second capacitor (C2) connects with the gate driving signals G(2N+1).

The GAS signal operation unit 500 includes a thirteenth transistor (PT12) and a fourth transistor (PT13). The gate and the drain of the thirteenth transistor (PT12) and the fourth transistor (PT13) receive the GAS signals (GAS). The drain of the thirteenth transistor (PT12) connects with the first constant-voltage source, i.e., the constant positive-voltage source (VGH). The source of the thirteenth transistor (PT12) connects with the common signal point P (2N+1). The source of the thirteenth transistor (PT12) connects with the gate driving signals G(2N+1).

The bootstrap capacitance unit 600 includes a bootstrap capacitance (Cload). One end of the bootstrap capacitance (Cload) connects with the gate driving signals G(2N+1), and the other end of the bootstrap capacitance (Cload) connected with the ground signals (GND).

Preferably, the GOA unit 21 further includes a voltage regulation unit 700 for regulating the voltage of the gate signal point Q (2N+1) and for avoiding electric leakage of the gate signal point Q (2N+1). Specifically, the voltage regulation unit 700 includes an eighth transistor (PT7) being serially connected between the source of the fifth transistor (PT4) and the gate signal point Q (2N+1). The gate of the eighth transistor (PT7) connects with the second constant-voltage source, i.e., the constant negative-voltage source (VGL). The drain of the eighth transistor (PT7) connects with the drain of the fifth transistor (PT4). The source of the eighth transistor (PT7) connects with the gate signal point Q (2N+1).

Preferably, the GOA unit 21 further includes a pull-up auxiliary unit 800 for avoiding the electric leakage occurring during a charging process applying to the gate signal point Q (2N+1) by the fifth transistor (PT4) and the sixth transistors (PT5). The pull-up auxiliary unit 800 includes a twelfth transistor (PT11). The gate of the twelfth transistor (PT11) connects with the drain of the first transistor (PT0) and the second transistor (PT1). The source of the twelfth transistor (PT11) connects with the common signal point P (2N+1). The drain of the twelfth transistor (PT11) connects with the first constant-voltage source, i.e., the constant positive-voltage source (VGH).

The configuration regarding the GOA unit 21 at the 1-th, 5-th, . . . (4N+1)-th level will be described hereinafter, wherein N is the natural number. The third transfer clock (CK_C1) may be the first level of transfer clock (CK_LA1), i.e., the first clock signals (CK1). The fourth level of transfer clock (CK_C2) may be the second level of transfer clock (CK_LA2), i.e., the third clock signals (CK3). The third control clock (CK_D1) may be the first control signals (CK_LB1), i.e., the second clock signals (CK2). The fourth control clock (CK_D2) may be the second control signals (CK_LB2), i.e., the fourth clock signals (CK4). The configuration regarding the GOA unit 21 at the 3-th, 7-th, . . . (4N+3)-th level will be described hereinafter, wherein N is the natural number. The third transfer clock (CK_C1) may be the second level of transfer clock (CK_LA2), i.e., the third clock signals (CK3). The fourth level of transfer clock (CK_C2) may be the first level of transfer clock (CK_LA1), i.e., the first clock signals (CK1). The third control clock (CK_D1) may be the second control signals (CK_LB2), i.e., the fourth clock signals (CK4). The fourth control clock (CK_D2) may be the second control signals (CK_LB2), i.e., the second clock signals (CK2).

It can be understood that when the GOA unit is the NMOS circuit, the transistors are NMOS transistors. The first scanning control signals correspond to the forward scanning control signals (U2D), and the second scanning control signals correspond to the backward scanning control signals (D2U), the first constant-voltage source corresponds to the constant negative-voltage source (VGL), and the second constant-voltage source corresponds to the constant positive-voltage source (VGH).

It can be understood that when the GOA unit within the first GOA sub-circuit is the PMOS circuit, the first control transistor (T1) and the second control transistor (T2) are PMOS transistor. When the GOA unit within the first GOA sub-circuit is the NMOS circuit, the first control transistor (T1) and the second control transistor (T2) are NMOS transistor.

The GOA unit 21 at the (2N+2)-th level of the second GOA circuit sub-circuit 202 is similar to the GOA unit 21 at the (2N+1)-th level of the second GOA circuit sub-circuit 202. The first level of transfer clock (CK_RA1), the second level of transfer clock (CK_RA2), the first control signals (CK_RB1), the second control signals (CK_RB2) of the GOA unit 21 at the (2N+2)-th level correspond to the first level of transfer clock (CK_LA1), the second level of transfer clock (CK_LA2), the first control signals (CK_LB1), and the second control signals (CK_LB2) of the GOA unit 21 at the (2N+1)-th level.

Figure 4:
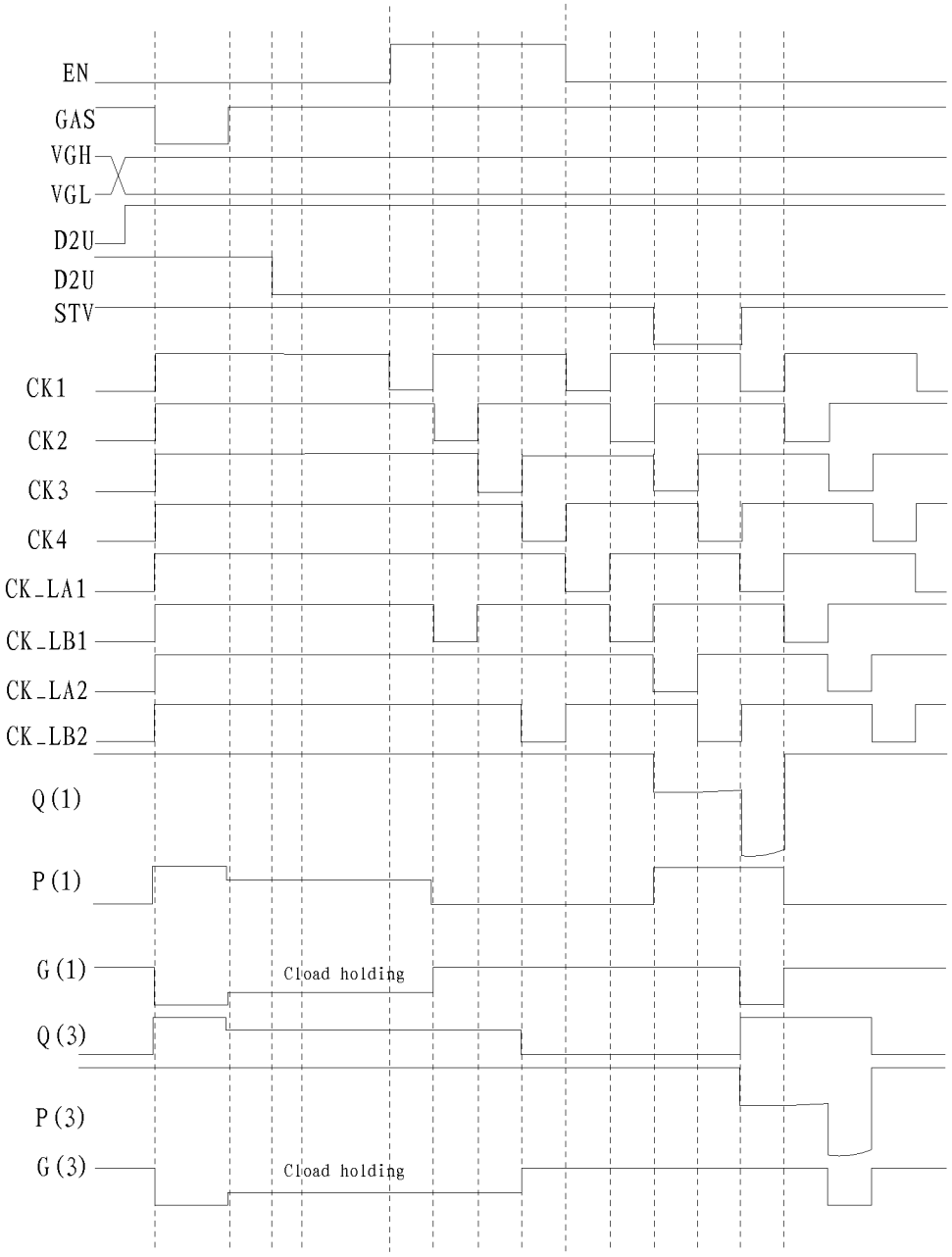
FIG. 4 is a timing diagram of the first GOA sub-circuit of the GOA circuit in accordance with the second embodiment.

FIG. 4 is a timing diagram of the first GOA sub-circuit of the GOA circuit in accordance with the second embodiment. In an example, the first GOA sub-circuit is the PMOS circuit.

When the GAS signals (GAS) is valid, that is, the GAS signals (GAS) is low level signals, the GOA circuit 20 implements the All-Gate-on function. The gate driving signals G(2N+1) corresponding to the horizontal signal lines at odd level outputs the low level signals. When the All-Gate-on function is completed, the gate driving signals G(2N+1) corresponding to the horizontal signal lines at odd level may not transit to high level immediately, but remains the low level signals.

In an example, the GOA circuit 20 has been forward driven. If the corresponding gate driving signals of the horizontal signal lines at odd level are not discharged to be at high level before the third clock signals (CK3) is valid, the horizontal signal lines at odd level, except for the horizontal signal lines at the first level, may generate redundant pulse signals. Specifically, the horizontal signal lines at the first level are driven by the GOA unit at the first level. As the level signals of the first GOA unit is the turn-on pulse signals (STV), the GOA unit at the first level is driven normally, that is, the GOA unit at the first level may not generate the redundant pulse signals. The third horizontal signal lines signal lines is driven by the GOA unit at the third level. The level signals of the third GPA unit is the gate driving signals G(1) of the GOA unit at the first level. When the first clock signals (CK1) at the low level, as the gate driving signals G(1) maintains the low level signals of the Cload holding, the low level signals of the gate driving signals G(1) may be transmitted to the gate signal point Q (3) of the GOA unit at the third level. As such, the GOA unit 21 at the third level operates before GOA unit 21 at the first level. In addition, the gate driving signals G(3) outputted by the GOA unit 21 at the third level may generate one redundant pulse, which may affect the gate driving signals of the GOA unit 21 at the next level. Basing on the same reasons, when the first clock signals (CK1) is valid, the gate driving signals of the GOA units at the seventh, eleventh, . . . , (4N+3)-th levels may generate the redundant pulse.

In order to overcome the above problems, as shown in FIG. 4, when the first clock signals (CK1) is valid, the enable signals (EN) are configured to be at high level for one entire operating period. At this moment, the first control transistor (T1) and the second control transistor (T2) are turned off. The first clock signals (CK1) and the third clock signals (CK3) are not transmitted to the first level of transfer clock (CK_LA1) and the second level of transfer clock (CK_LA2). At this moment, the GOA unit of the first GOA sub-circuit 201 are controlled by the first control signals (CK_LB1) and the second control signals (CK_LB2), that is the second clock signals (CK2) and the fourth clock signals (CK4) such that the common signal point P (2N+1) is at low level signals. Under the circumstances, the gate driving signals G(2N+1) are at high level before the third clock signals (CK3) is valid, which avoids the redundant pulse signals. Afterward, the first GOA sub-circuit 201 is driven by the first clock signals (CK1), the second clock signals (CK2), the third clock signals (CK3), and the fourth clock signals (CK4) in turn so as to charge the horizontal signal lines. One operating period relates to the time period for which the first clock signals (CK1), the second clock signals (CK2), the third clock signals (CK3), and the fourth clock signals (CK4) are valid in turn.

In the second embodiment, the operating timing of the second GOA circuit sub-circuit 202 is similar to that of the first GOA sub-circuit 201, and thus is omitted hereinafter.

In the present disclosure, a LCD includes the above GOA circuit.

In view of the above, by charging all of the horizontal signal lines by the GOA circuit at the same time, the first level of transfer clock and the second level of transfer clock are masked such that the first control clock and the second control clock control the gate driving signals of the horizontal signal lines to be discharged until being equal to the predetermined level. In this way, the horizontal signal lines are prevented from generating redundant pulse signals before the first gate driving signals are outputted, which ensures the normal operations of the GOA circuit.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A gate driver on array (GOA) circuit, comprising:

a plurality of cascaded GOA units, each of the GOA units being driven by a first level of transfer clock, a second level of transfer clock, a first control clock and a second control clock to charge horizontal signal lines corresponding to a display area, the first level of transfer clock and the second level of transfer clock configured to control an input of level signals of the GOA units and to generate gate driving signals, the first control clock and the second control clock configured to control the gate driving signals to be at a predetermined level, wherein the level signals are turn-on pulse signals or the gate driving signals between the adjacent GOA units; and a control module configured to mask the first level of transfer clock and the second level of transfer clock when all of the horizontal signal lines being charged completely by the GOA circuit, the gate driving signals on the horizontal signal lines controlled by the first control clock and the second control clock being discharged until the level of the gate driving signals equals to the predetermined level, such that the horizontal signal lines being prevented from generating redundant pulse signals before the first gate driving signals are outputted, wherein the control module comprises a first control module and a second control module, wherein the GOA circuit receives first clock signals, second clock signals, third clock signals, and fourth clock signals, and the first clock signals, the second clock signals, the third clock signals, and the fourth clock signals are respectively valid within one operating period in turn;

the GOA circuit comprising a first GOA sub-circuit being formed by the cascaded GOA units at odd levels, when being driven by the first level of transfer clock, the second level of transfer clock, the first control signals, and the second control signals, the first GOA sub-circuit charges the horizontal signal lines at odd levels;

within the first GOA sub-circuit, the first level of transfer clock and the second level of transfer clock corresponding to the first clock signals and the third clock signals, and the first control signals and the second control signals corresponding to the second clock signals and the fourth clock signals, wherein the first control module corresponds to the first GOA sub-circuit, the first control module is configured to mask the first clock signals and the third clock signals of the first GOA sub-circuit such that the gate driving signals on the horizontal signal lines at odd levels being discharged until the level equals to the predetermined level when being controlled by the second clock signals and the fourth clock signals, wherein the GOA circuit further comprises a second GOA sub-circuit being formed by the cascaded GOA units at even levels, when being driven by the first level of transfer clock, the second level of transfer clock, the first control signals, and the second control signals, the second GOA sub-circuit charges the horizontal signal lines at even levels;

within the second GOA sub-circuit, the first level of transfer clock and the second level of transfer clock correspond to the second clock signals and the fourth clock signals, and the first control signals and the second control signals correspond to the first clock signals and the third clock signals; and the second control module corresponds to the second GOA sub-circuit, the second control module is configured to mask the second clock signals and the fourth clock signals of the first GOA sub-circuit such that the gate driving signals on the horizontal signal lines at even levels being discharged until the level equals to the predetermined level when being controlled by the first clock signals and the third clock signals.

2. The GOA circuit as claimed in claim 1, wherein the first control module comprises a first control transistor and a second control transistor, first ends of the first control transistor and the second control transistor are connected to receive enable signals, second ends of the first control transistor and the second control transistor correspondingly connect to first clock signals and third clock signals, third ends of the first control transistor and the second control transistor connect to the GOA units, when all of the horizontal scanning lines are completely charged by the GOA circuit, the enable signals control the first control transistor and the second control transistor to mask the first level of transfer clock and the second level of transfer clock such that the first control clock and the second control clock control the gate driving signals on all of the horizontal signal lines to be at the predetermined level.

3. The GOA circuit as claimed in claim 2, wherein the first control transistor and the second control transistor are PMOS transistors, the first ends, the second ends, the third ends of the first control transistor and the second control transistor respectively correspond to the gate, the drain and the source of the PMOS transistors, when the enable signals are at high level, the first control transistor and the second control transistor are turned off.

4. The GOA circuit as claimed in claim 2, wherein the first control transistor and the second control transistor are NMOS transistors, the first ends, the second ends, the third ends of the first control transistor and the second control transistor respectively correspond to the gate, the drain and the source of the NMOS transistors, when the enable signals are at low level, the first control transistor and the second control transistor are turned off.

5. The GOA circuit as claimed in claim 1, wherein the GOA unit comprises a forward-backward scanning unit, an input control unit, a pull-up holding unit, an output control unit, a GAS signal operation unit, and a bootstrap capacitance unit; wherein the forward-backward scanning unit comprises a first transistor, a second transistor, a third transistor, and a fourth transistor, the gate of the first transistor receives the first scanning control signals, the source of the first transistor receives the gate driving signals outputted from the GOA unit at the next level, the gate of the second transistor receives the second scanning control signals, the source of the second transistor receives the gate driving signals outputted by the GOA unit at the previous level, the drain of the first transistor and the second transistor are connected and then are further connected with the input control unit, the gate of the third transistor receives the first scanning control signals, the source of the third transistor receives the third control clock, the gate of the fourth transistor receives the second scanning control signals, the source of the fourth transistor receives the fourth control clock, the drains of the third transistor and the fourth transistor are connected and then are further connected with the pull-up holding unit; the input control unit comprises a fifth transistor, the gate of the fifth transistor receives the third transfer clock, the source of the fifth transistor is connected with the drains of the first transistor and the second transistor, and the drain of the fifth transistor connects with the gate signal point; the pull-up holding unit comprises a sixth transistor, a seventh transistor, a ninth transistor, a tenth transistor, and a first capacitor, the gate of the sixth transistors connects with the common signal point, the source of the sixth transistors connects with the drain of the fifth transistor, the drain of the sixth transistors connects with a first constant-voltage source, the gate of the seventh transistor connects with the fifth transistor, the source of the seventh transistor connects with the common signal point, the drain of the seventh transistor connects with the first constant-voltage source, the gate of the ninth transistor and the source of the third transistor and the fourth transistor are connected, the source of the ninth transistor connects with a second constant-voltage source, the drain of the ninth transistor connects with the common signal point, the gate of the tenth transistor connects with the common signal point, the source of the tenth transistor connects with the gate driving signals, the drain of the tenth transistor connects with the first constant-voltage source, one end of the first capacitor connects with the first constant-voltage source, and the other end of the first capacitor connects with the common signal point; the output control comprises an eleventh transistor and a second capacitor, the gate of the eleventh transistor connects with the gate signal point, the drain of the eleventh transistor connects with the gate driving signals, the source of the eleventh transistor receives the fourth level of transfer clock, one end of the second capacitor connects with the gate signal point, and the other end of the second capacitor connects with the gate driving signals; the GAS signal operation unit comprises a thirteenth transistor and a fourth transistor, the gate and the drain of the thirteenth transistor and the fourth transistor receives the GAS signals, the drain of the thirteenth transistor connects with the first constant-voltage source, the source of the thirteenth transistor connects with the common signal point, the source of the thirteenth transistor connects with the gate driving signals; the bootstrap capacitance unit comprises a bootstrap capacitance, one end of the bootstrap capacitance connects with the gate driving signals, and the other end of the bootstrap capacitance connected with the ground signals; and the third level of transfer clock and the fourth level of transfer clock correspond to the first level of transfer clock and the second level of transfer clock or the second level of transfer clock and the first level of transfer clock, and the third level of transfer clock and the fourth level of transfer clock correspond to the first control clock and the second control clock or the second control clock and the first control clock.

6. The GOA circuit as claimed in claim 5, wherein the GOA unit further comprises a voltage regulation unit having an eighth transistor being serially connected between the source of the fifth transistor and the gate signal point, the gate of the eighth transistor connects with the second constant-voltage source, the drain of the eighth transistor connects with the drain of the fifth transistor, and the source of the eighth transistor connects with the gate signal point.

7. The GOA circuit as claimed in claim 6, wherein the GOA unit further comprises a pull-up auxiliary unit having a twelfth transistor, the gate of the twelfth transistor connects with the drain of the first transistor and the second transistor, the source of the twelfth transistor connects with the common signal point, and the drain of the twelfth transistor connects with the first constant-voltage source.

8. A liquid crystal device (LCD), comprising: a gate driver on array (GOA) circuit comprising a plurality of cascaded GOA units, each of the GOA units being driven by a first level of transfer clock, a second level of transfer clock, a first control clock and a second control clock to charge horizontal signal lines corresponding to a display area, the first level of transfer clock and the second level of transfer clock configured to control an input of level signals of the GOA units and generate gate driving signals, the first control clock and the second control clock configured to control the gate driving signals to be at a predetermined level, wherein the level signals are turn-on pulse signals or the gate driving signals between the adjacent GOA units; and a control module configured to mask the first level of transfer clock and the second level of transfer clock when all of the horizontal signal lines being charged completely by the GOA circuit, the gate driving signals on the horizontal signal lines controlled by the first control clock and the second control clock being discharged until the level of the gate driving signals equals to the predetermined level, such that the horizontal signal lines being prevented from generating redundant pulse signals before the first gate driving signals are outputted, wherein the control module comprises a first control module and a second control module, wherein the GOA circuit receives first clock signals, second clock signals, third clock signals, and fourth clock signals, and the first clock signals, the second clock signals, the third clock signals, and the fourth clock signals are respectively valid within one operating period in turn;

the GOA circuit comprising a first GOA sub-circuit being formed by the cascaded GOA units at odd levels, when being driven by the first level of transfer clock, the second level of transfer clock, the first control signals, and the second control signals, the first GOA sub-circuit charges the horizontal signal lines at odd levels;

within the first GOA sub-circuit, the first level of transfer clock and the second level of transfer clock corresponding to the first clock signals and the third clock signals, and the first control signals and the second control signals corresponding to the second clock signals and the fourth clock signals, wherein the first control module corresponds to the first GOA sub-circuit, the first control module is configured to mask the first clock signals and the third clock signals of the first GOA sub-circuit such that the gate driving signals on the horizontal signal lines at odd levels being discharged until the level equals to the predetermined level when being controlled by the second clock signals and the fourth clock signals, wherein the GOA circuit further comprises a second GOA sub-circuit being formed by the cascaded GOA units at even levels, when being driven by the first level of transfer clock, the second level of transfer clock, the first control signals, and the second control signals, the second GOA sub-circuit charges the horizontal signal lines at even levels;

within the second GOA sub-circuit, the first level of transfer clock and the second level of transfer clock correspond to the second clock signals and the fourth clock signals, and the first control signals and the second control signals correspond to the first clock signals and the third clock signals, and wherein the second control module corresponds to the second GOA sub-circuit, the second control module is configured to mask the second clock signals and the fourth clock signals of the first GOA sub-circuit such that the gate driving signals on the horizontal signal lines at even levels being discharged until the level equals to the predetermined level when being controlled by the first clock signals and the third clock signals.

9. The LCD as claimed in claim 8, wherein the first control module comprises a first control transistor and a second control transistor, first ends of the first control transistor and the second control transistor are connected to receive enable signals, second ends of the first control transistor and the second control transistor correspondingly connect to first clock signals and third clock signals, third ends of the first control transistor and the second control transistor connect to the GOA units, when all of the horizontal scanning lines are completely charged by the GOA circuit, the enable signals control the first control transistor and the second control transistor to mask the first level of transfer clock and the second level of transfer clock such that the first control clock and the second control clock control the gate driving signals on all of the horizontal signal lines to be at the predetermined level.

10. The LCD as claimed in claim 9, wherein the first control transistor and the second control transistor are PMOS transistors, the first ends, the second ends, the third ends of the first control transistor and the second control transistor respectively correspond to the gate, the drain and the source of the PMOS transistors, when the enable signals are at high level, the first control transistor and the second control transistor are turned off.

11. The LCD as claimed in claim 9, wherein the first control transistor and the second control transistor are NMOS transistors, the first ends, the second ends, the third ends of the first control transistor and the second control transistor respectively correspond to the gate, the drain and the source of the NMOS transistors, when the enable signals are at low level, the first control transistor and the second control transistor are turned off.

12. The LCD as claimed in claim 8, wherein the GOA unit comprises a forward-backward scanning unit, an input control unit, a pull-up holding unit, an output control unit, a GAS signal operation unit, and a bootstrap capacitance unit; wherein the forward-backward scanning unit comprises a first transistor, a second transistor, a third transistor, and a fourth transistor, the gate of the first transistor receives the first scanning control signals, the source of the first transistor receives the gate driving signals outputted from the GOA unit at the next level, the gate of the second transistor receives the second scanning control signals, the source of the second transistor receives the gate driving signals outputted by the GOA unit at the previous level, the drain of the first transistor and the second transistor are connected and then are further connected with the input control unit, the gate of the third transistor receives the first scanning control signals, the source of the third transistor receives the third control clock, the gate of the fourth transistor receives the second scanning control signals, the source of the fourth transistor receives the fourth control clock, the drains of the third transistor and the fourth transistor are connected and then are further connected with the pull-up holding unit; the input control unit comprises a fifth transistor, the gate of the fifth transistor receives the third transfer clock, the source of the fifth transistor is connected with the drains of the first transistor and the second transistor, and the drain of the fifth transistor connects with the gate signal point; the pull-up holding unit comprises a sixth transistor, a seventh transistor, a ninth transistor, a tenth transistor, and a first capacitor, the gate of the sixth transistors connects with the common signal point, the source of the sixth transistors connects with the drain of the fifth transistor, the drain of the sixth transistors connects with a first constant-voltage source, the gate of the seventh transistor connects with the fifth transistor, the source of the seventh transistor connects with the common signal point, the drain of the seventh transistor connects with the first constant-voltage source, the gate of the ninth transistor and the source of the third transistor and the fourth transistor are connected, the source of the ninth transistor connects with a second constant-voltage source, the drain of the ninth transistor connects with the common signal point, the gate of the tenth transistor connects with the common signal point, the source of the tenth transistor connects with the gate driving signals, the drain of the tenth transistor connects with the first constant-voltage source, one end of the first capacitor connects with the first constant-voltage source, and the other end of the first capacitor connects with the common signal point; the output control unit comprises an eleventh transistor and a second capacitor, the gate of the eleventh transistor connects with the gate signal point, the drain of the eleventh transistor connects with the gate driving signals, the source of the eleventh transistor receives the fourth level of transfer clock, one end of the second capacitor connects with the gate signal point, and the other end of the second capacitor connects with the gate driving signals; the GAS signal operation unit comprises a thirteenth transistor and a fourth transistor, the gate and the drain of the thirteenth transistor and the fourth transistor receives GAS signals, the drain of the thirteenth transistor connects with the first constant-voltage source, the source of the thirteenth transistor connects with the common signal point, the source of the thirteenth transistor connects with the gate driving signals; the bootstrap capacitance unit comprises a bootstrap capacitance, one end of the bootstrap capacitance connects with the gate driving signals, and the other end of the bootstrap capacitance connected with the ground signals; and the third level of transfer clock and the fourth level of transfer clock correspond to the first level of transfer clock and the second level of transfer clock or the second level of transfer clock and the first level of transfer clock, and the third level of transfer clock and the fourth level of transfer clock correspond to the first control clock and the second control clock or the second control clock and the first control clock.

13. The LCD as claimed in claim 12, wherein the GOA unit further comprises a voltage regulation unit having an eighth transistor being serially connected between the source of the fifth transistor and the gate signal point, the gate of the eighth transistor connects with the second constant-voltage source, the drain of the eighth transistor connects with the drain of the fifth transistor, and the source of the eighth transistor connects with the gate signal point.

14. The LCD as claimed in claim 13, wherein the GOA unit further comprises a pull-up auxiliary unit having a twelfth transistor, the gate of the twelfth transistor connects with the drain of the first transistor and the second transistor, the source of the twelfth transistor connects with the common signal point, and the drain of the twelfth transistor connects with the first constant-voltage source.

* * * * *